US010958017B2

(12) United States Patent
Bredbeck et al.

(10) Patent No.: US 10,958,017 B2
(45) Date of Patent: Mar. 23, 2021

(54) CONTACT ELEMENT FOR A CONNECTOR

(71) Applicant: Rosenberger Hochfrequenztechnik GmbH & Co. KG, Fridolfing (DE)

(72) Inventors: Till Bredbeck, Traunstein (DE); Martin Zebhauser, Laufen (DE); Florian Hohenadl, Taching am See (DE)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 0 days.

(21) Appl. No.: 16/607,865

(22) PCT Filed: Apr. 26, 2018

(86) PCT No.: PCT/EP2018/060797
§ 371 (c)(1),
(2) Date: Oct. 24, 2019

(87) PCT Pub. No.: WO2018/197641
PCT Pub. Date: Nov. 1, 2018

(65) Prior Publication Data

US 2020/0119495 A1 Apr. 16, 2020

(30) Foreign Application Priority Data

Apr. 28, 2017 (EP) ..... 17168727

(51) Int. Cl.
*H01R 13/6582* (2011.01)
*H01R 13/11* (2006.01)

(52) U.S. Cl.
CPC ..... *H01R 13/6582* (2013.01); *H01R 13/11* (2013.01)

(58) Field of Classification Search
CPC ..... H01R 13/6582; H01R 13/11
(Continued)

(56) References Cited

U.S. PATENT DOCUMENTS 3,051,925 A 8/1962 Felts
4,936,795 A * 6/1990 Kawai ..... H01R 13/655 439/607.19
(Continued)

FOREIGN PATENT DOCUMENTS

DE 19913898 C1 1/2001
DE 202009015286 U1 1/2010
(Continued)

OTHER PUBLICATIONS

Publication, WO 2018/197641 A1, Nov. 1, 2018.
(Continued)

*Primary Examiner* — Peter G Leigh
(74) *Attorney, Agent, or Firm* — Randall Danskin P.S.

(57) ABSTRACT

The invention relates to a contact element (1) for a connector (2), having: an at least partially electrically conductive housing (3) for connection to an earth conductor (4.2) of an electrical cable (4), and at least one inner conductor part (6) for connection to at least one signal lead (4.4) of the electrical cable (4). In a contact region (9) of the housing (3) at the front in the insertion direction, there are at least two resilient tongues (10, 11), wherein the resilient tongues (10, 11) are each secured movably at a first, free end (10.1, 11.1) and immovably at a second end (10.2, 11.2). There are two groups of resilient tongues (10, 11), wherein the resilient tongues (10) of a first group are arranged such that the free ends (10.1) thereof face a front end (9.1) of the contact region (9), and the resilient tongues (11) of a second group are arranged such that the free ends (11.1) thereof face away from the front end (9.1) of the contact region (9).

17 Claims, 7 Drawing Sheets

(58) Field of Classification Search
USPC ..... 439/578
See application file for complete search history.

(56) References Cited

U.S. PATENT DOCUMENTS 4,938,714 A * 7/1990 Kawai ..... H01R 13/6582 439/607.01
5,007,862 A * 4/1991 Defibaugh ..... H01R 13/64 439/564
5,017,157 A * 5/1991 Liu ..... H01R 13/6584 439/353
5,035,650 A * 7/1991 Defibaugh ..... H01R 13/6582 439/607.17
5,041,022 A * 8/1991 Sekiguchi ..... H01R 13/627 439/607.17
6,200,162 B1 * 3/2001 Aoyama ..... H01R 4/184 439/578
6,764,338 B2 * 7/2004 Fang ..... H01R 12/721 439/607.2
6,808,417 B2 * 10/2004 Yoshida ..... H01R 9/0518 439/585
6,951,483 B2 * 10/2005 Kameyama ..... H01R 9/0518 439/595
7,318,742 B2 * 1/2008 Morikawa ..... H01R 9/0518 174/75 C
7,488,211 B2 * 2/2009 Yamaoka ..... H01R 13/4364 439/595
8,052,477 B1 * 11/2011 Ko ..... H01R 13/6582 439/660
8,460,036 B1 * 6/2013 Chen ..... H01R 13/6581 439/660
8,602,825 B2 * 12/2013 Chen ..... H01R 13/6658 439/660
8,777,670 B2 * 7/2014 Blakborn ..... H01R 31/06 439/638
8,821,170 B1 9/2014 Thein et al.
9,106,025 B2 * 8/2015 Brode ..... H01R 13/6583
9,231,349 B2 * 1/2016 Yang ..... H01R 13/6582
9,281,598 B2 * 3/2016 Zebhauser ..... H01R 13/03
9,627,815 B2 * 4/2017 Wu ..... H01R 13/6581
9,673,568 B2 * 6/2017 Tanaka ..... H01R 13/6593
9,787,017 B1 * 10/2017 Lane ..... H01R 9/05
9,960,504 B2 * 5/2018 Hikosaka ..... H01R 4/18
2003/0176104 A1 9/2003 Hall et al.
2007/0190868 A1 * 8/2007 De Cloet ..... H01R 13/6277 439/851
2009/0017678 A1 1/2009 Meier et al.
2011/0263156 A1 10/2011 Ko
2016/0285208 A1 9/2016 Wu et al.

FOREIGN PATENT DOCUMENTS

EP 0558544 B1 9/1993
EP 0558544 B1 1/1995
EP 2814120 A1 12/2014

OTHER PUBLICATIONS

PCT Request, PCT/EP2018/060797, Apr. 26, 2018.
PCT Notification of Receipt of Record Copy, PCT/EP2018/060797, May 24, 2018.
PCT Notification Concerning Submission, Obtention or Transmittal of Priority Document, PCT/EP2018/060797, May 25, 2018.
PCT Second and Supplementary Notice Informing the Applicantof the Communicationof the International Application, PCT/EP2018/060797, Aug. 29, 2019.
Notification of Transmittal of the International Search Report and the Written Opinion of the International Searching Authority, or the Declaration, PCT/EP2018/060797, dated Jun. 15, 2018.

* cited by examiner

CONTACT ELEMENT FOR A CONNECTOR

The invention relates to a contact element for a connector, having an at least partially electrically conductive housing for connection to an outer conductor of an electrical line, and having at least one inner conductor part for connection to at least one inner conductor of the electrical line, according to the preamble of claim 1.

The invention also relates to a connector, especially a coupling or a bush. The invention moreover relates to a plug connection, having a first connector, especially a coupling or bush, and a second connector which can be plugged into it. The invention furthermore relates to a method for producing an electrical connection between two connectors according to the preamble of claim 15.

Connectors serve for producing an electrical connection with a corresponding other mating connector. A connector may be a plug, a bush, a coupling or an adapter. The term "connector" used in the context of the invention is representative of all variants.

Usually connectors are used in the manner of a coupling or a plug to manufacture cables. For this, a contact element is generally provided in the connectors, which is electrically connected to an outer conductor of the cable and at least one inner conductor of the cable.

Known connectors generally have a connector housing, preferably a plastic housing, with a seat for installing the at least one contact element.

Connectors and contact elements should have two properties in particular. On the one hand, they should be of mechanically robust or durable design, for example in order to withstand multiple insertions and removals and forces and torsional forces acting orthogonally to the insertion direction without suffering damage. Moreover, the connector should provide good electrical properties, including a sufficiently good electromagnetic shielding, and ensure low contact resistances and a (vibrationally) secure contacting, especially when the connector is supposed to be suitable for high-frequency applications.

In order to ensure a low-resistance and vibrationally secure or mechanically stable electrical connection, resilient tongues are often arranged on the contact element in the prior art, ensuring a contacting with a mating connector. The structural design of such a contact element, which at the same time should for example also be robust with respect to overextension, is not simple to manufacture.

Regarding other technical background, reference is made for example to DE 199 13 898 C1. This document relates to an outer conductor sleeve with spring contacts for the plug part of an HF coaxial connector consisting of a plug part and a bush part, which is formed by lengthwise slots on its circumference as a spring lamella ring, in which the spring lamella ring comprises a common ring base for the spring lamellas and in which the spring lamellas have external contact cusps in the region of their free ends. The outer conductor sleeve disclosed in DE 199 13 898 C1 is supposed to provide an overextension protection with no additional elements and to permit a distribution of the bending stress upon radial deflection of the spring lamellas roughly uniformly over their length.

One problem of the known prior art is that a compromise must be made between the easy, and thus comfortable, inserting of the connector and as large as possible a mechanical holding force afterwards.

A further problem of the prior art is that the usual solutions with the resilient tongues or spring lamellas usually do not assure an ideal electromagnetic shielding, since the contact element can no longer be fully enclosed. For this reason, the known connectors are often limited in their maximum transmitted frequency. Furthermore, the stability of the contact element is impaired by the formation of spring lamellas from the housing or the outer conductor sleeve.

Moreover, contact elements are known from the general prior art that are formed from a housing and a contact sleeve inserted into the housing. These solutions usually have the drawback that the insertion forces to plug together two connectors are large. Moreover, the known solutions are only partially suitable for high-frequency applications.

The contact elements known from the general prior art are often designed for easy insertion and usually do not offer suitable resistance, especially to orthogonally acting forces, so that consequently they are easily bent.

The problem, which the present invention proposes to solve, is to provide an improved contact element for a connector which is suitable for also absorbing forces acting orthogonally to the insertion direction and which has good electrical properties, especially for high-frequency applications.

Moreover, the problem, which the present invention proposes to solve, is to provide a method for producing an electrical connection between two connectors, wherein the plug connection is especially suited to high frequencies.

These problems are solved for the contact element by claim 1 and for the method by claim 15.

Finally, the problem, which the present invention proposes to solve, is to provide an improved connector as compared to the prior art and an improved plug connection.

This problem is solved by the features of claim 13 and claim 14, respectively.

The dependent claims relate to advantageous embodiments and variants of the invention.

The contact element according to the invention for a connector comprises an at least partially electrically conductive housing for connection to a grounding conductor of an electrical line. Moreover, the contact element comprises at least one inner conductor part for connection to at least one signal conductor of the electrical line.

By an electrical line is meant any given device for the transport or transmission of electrical energy for data transmission and/or for electrical power supply. Preferably, the electrical line is an electrical cable which consists of an assemblage of multiple individual lines. An electrical cable in this case has a grounding conductor or outer conductor and one or more signal conductors in the form of inner conductors. The invention is especially suitable for use with a coaxial cable (with an individual inner conductor).

But it may also be provided in the sense of the invention that the electrical line is an electrical line of an electrical appliance, a further connector or an electrical line on a circuit board.

By the term "grounding conductor" is meant any given electrical conductor carrying a ground potential or some other reference potential.

By the term "signal conductor" is meant any given conductor for the transmission of electrical data signals and/or electrical power supply signals.

For better comprehension, the invention shall be described in the following substantially with the aid of the connection to an electrical cable. Of course, this should not be taken in a limiting way. A person skilled in the art may apply the terms "cable", "outer conductor" and "inner conductor" easily to the more general terms "line", "grounding conductor" and "signal conductor".

Preferably, the housing is completely electrically conductive and for this purpose it is formed as a single piece of a suitable electrically conductive material. However, the housing may also comprise nonconductive or poorly conductive parts or regions. For example, the housing may comprise plastic parts for fastening to a connector housing and/or for connecting to other components (also components of the contact element).

According to the invention, it is provided that in a contact region of the housing situated at the front of the housing in the insertion direction there are arranged at least two resilient tongues, wherein the resilient tongues are each secured, movably at a first free end, and immovably at a second end.

A resilient tongue may be a structural part which can be deformed sufficiently elastically during use or be at least partially elastically fashioned in the region of the secured end. The resilient tongues are preferably entirely conductive and for this they are formed from metal, for example. The resilient tongues may be formed for example as bending springs, especially leaf springs. Preferably, the resilient tongues can move at their free, movable ends, from a base position within a predetermined deflection region, wherein the spring force seeks to move the resilient tongues back to the base position upon being deflected from the base position. The resilient tongues are substantially mounted or secured so as to pivot about their second, immovable end (with spring action).

According to the invention, two groups of resilient tongues are provided, wherein the resilient tongues of a first group are arranged such that their free ends are arranged facing toward a front end of the contact region and the resilient tongues of a second group are arranged such that their free ends are arranged facing away from the front end of the contact region. A group, in the sense of the invention, comprises at least one resilient tongue, preferably at least two resilient tongues.

The contact region of the housing is a front portion/region of the housing in the insertion direction, which serves for the electrical contacting with a further or second connector. Consequently, a second connector can be at least partially inserted into the contact region in order to produce an electrical connection and/or pushed at least partially onto the contact region for this purpose. Thus, by the front end of the contact region is meant the end of the contact element facing toward the second connector being inserted or pushed onto it, which is situated in front along the insertion direction on the contact element.

Thus, it is provided according to the invention that the at least one resilient tongue of the first group is arranged and oriented such that its (respective) first free end along the insertion direction is located in front of its second immovably secured end. That is, the free end of the resilient tongue is contacted at first by an inserted or pushed connector and thus before the secured end, i.e., it lies in front in the insertion direction or before the secured end. The at least one resilient tongue of the second group is arranged or oriented in the opposite way to this, accordingly.

The invention is suitable for use with any given number of signal conductors (or inner conductors) of the electrical line (or electrical cable). Thus, there may be provided more than one inner conductor part. For example, two, three, four, five, six, seven, eight or more inner conductor parts may be provided for the connection to any given number of signal conductors (or inner conductors) in the sense of the invention.

The number of signal conductors or inner conductor parts is thus not limited in the present case, while common connectors, especially HF connectors and connectors for coaxial cables usually have only one inner conductor part for connection to one inner conductor of the cable.

It may also be provided that the number of inner conductor parts and signal conductors is not the same. For example, a multitude of inner conductor parts may be connected to a smaller number of signal conductors (or a single signal conductor)—and vice versa.

The inventors have discovered that a contact element whose resilient tongues are divided into two groups, where the free ends of resilient tongues of the two groups are oriented respectively opposite along the insertion direction, enables an especially high-quality electrical contacting, suitable for high-frequency applications. This is due to the fact that the current paths between the connectors involved in the electrical contacting can run especially advantageously and directly owing to the arrangement of the resilient tongues according to the invention. Large loops which would have negative impact on the performance of the plug connection can be avoided according to the invention.

It has been found that a connector designed according to the invention is particularly suited to the transmission of high-frequency signals for this reason. Whereas with the comparable connectors known up to this time only a maximum transmission frequency of 3 to 6 GHz was possible, a connector outfitted according to the invention makes possible a transmission of frequencies up to at least 9 GHz.

The free ends of the resilient tongues may have contact cusps, bulges or bends to improve the contacting with another connector being inserted or pushed onto it.

In one modification of the invention it may be provided that the contact element comprises an at least partially electrically conductive contact sleeve, which is electrically conductively connected to the housing, and which forms the resilient tongues.

The contact sleeve can preferably be received by the housing of the contact element. But it may also be provided that the contact sleeve receives the housing of the contact element.

The contact sleeve may extend, starting from the front end of the contact region, in the insertion direction along the contact region. The contact sleeve may be formed smaller, the same size, or larger than the contact region along the insertion direction.

It may thus be provided according to the invention that the contact sleeve is arranged on a contact region of the housing situated at the front in the insertion direction, while the contact sleeve forms at least two resilient tongues.

Preferably, the contact sleeve is entirely conductive, for example, formed as a single piece of an electrically conductive material. However, the contact sleeve may also contain nonconductive or poorly conductive parts or regions. The contact sleeve may contain plastic parts which serve, for example, for the mechanical connection to the housing of the contact element.

The contact sleeve may be connected conductively to the housing of the contact element by contact regions, contact points, or by complete physical contact. A large-area and thus low-resistance connection may be preferred.

The contact sleeve may be connected to the housing of the contact element by form fitting, force locking and/or material bonding. For example, the contact sleeve may be press-fitted to the housing of the contact element or be locked in it.

It may be provided that the contact element is used for a connector whose output direction (of the line) does not run along the insertion direction or one which is designed for the electrical connection to a second connector whose output direction (of the line) does not run along the insertion direction. For example, connectors are known whose output direction runs at 90° to the insertion direction. Especially in this case, unwanted sometimes large transverse forces may occur, for example when a user applies force to a cable outlet not running along the insertion direction. In this way, irreparable damage may be caused to the plug connection or the interface.

The contact element according to the invention minimizes, especially in advantageous embodiments, the danger of damaging the plug connection or the interface. Because the housing of the contact element can be reinforced almost independently of the contact sleeve and/or the resilient tongues, on the whole an especially robust contact element can be provided. That is, the stability of the contact element, especially with respect to forces acting orthogonally to the insertion direction, can be improved. At the same time, however, it can also be assured that the necessary force for the contacting with a second connector is at least not significantly increased, since this depends only on the contact sleeve or the resilient tongues and not on the housing. It is thus possible to increase the robustness or the mechanical stability and/or holding force or the contact normal force of the contact element independently of the necessary insertion force.

A further benefit of providing a contact sleeve is that the contact element or the connector can be made in modular technology.

Moreover, the contact sleeve, being a highly stressed component, can be easily replaced when damaged, without having to replace the entire contact element or connector.

In one modification of the invention it may also be provided that the resilient tongues are formed as a single piece with the housing.

It may also be provided that one or more resilient tongues are fastened individually by their immovable ends on the housing, for example by riveting, clamping or gluing.

A contact sleeve in the sense of the invention thus need not be provided absolutely. Depending on the purpose of use of the connector or contact element, this simplified variant may also potentially be of economic benefit. Generally, however, the use of a contact sleeve will be beneficial.

A variant in which some of the resilient tongues, such as a group of resilient tongues, are formed on the housing and other resilient tongues, such as the other group, are formed on the contact sleeve, can also be provided.

In one modification of the invention it may be provided that the housing and/or the contact sleeve have a round cross section.

The housing and/or the contact sleeve may basically have any given cross section, such as even a rectangular cross section. It may also be provided that the housing of the contact element and the contact sleeve each have different cross section shapes. For example, it may be provided that the housing of the contact element has a rectangular cross section and the contact sleeve has a round cross section—or vice versa.

However, round cross sections have proven to be advantageous in manufacturing technology, especially in the use of coaxial cables or coaxial connectors. Such contact elements or connectors can also be especially robust.

In one modification of the invention it may be provided that the contact region forms an inner space to receive a second connector and the free ends of the resilient tongues protrude into the inner space for the contacting with the second connector.

It may thus be provided preferably that the resilient tongues are arranged or formed on the inside of the housing or the contact sleeve. The free ends of the resilient tongues protrude preferably into the inner space, which means that they are forced out from the inner space when the second connector is inserted, until they run substantially coplanar with the inner wall of the housing or the contact sleeve. An especially high-quality electrical contacting exists between the contact element according to the invention and the inserted second connector owing to the acting spring forces, especially in the region of the free ends of the resilient tongues. The electrical connection is thus most especially vibrationally secure and robust.

Especially when a contact sleeve is provided, the free ends can preferably be forced against the housing of the contact element when the second connector is inserted, by which the electrical connection on the whole is even further improved.

Alternatively, of course, it may also be provided that the free ends of the resilient tongues protrude outward from the contact region, so that the second connector can be pushed onto the contact element and thereby contact the resilient tongues on the outside of the housing of the contact element.

However, it is preferable, especially when using a contact sleeve, for the contact region or the contact sleeve to form an inner space. The housing of the contact elements can then be used advantageously for the electromagnetic shielding of the contact region, which is possible especially effectively when the housing itself has no resilient tongues.

In one modification of the invention it may be provided that the housing and/or the contact sleeve are formed entirely of metal.

Any suitable metals and alloys may be provided, such as those having or consisting of silver, copper, gold, aluminum, bronze, or alloys formed from these.

In one modification of the invention, the housing may be formed fully closed at least in the contact region along its circumference.

Especially when the housing is formed completely conductive and is connected to the grounding conductor of the electrical line, an especially high-quality electromagnetic shielding can be produced in this way. Preferably, the housing is formed closed for its entire length along its circumference. An electromagnetic shielding can thus be provided in the region of the housing that serves for the connection to the electrical line.

A fully closed configuration of the housing along its circumference moreover has the advantage that transverse forces, especially those acting orthogonally to the inserting lengthwise axis, can be especially well absorbed, since the housing has good stability owing to a closed configuration and in particular is not weakened, as in the prior art, by breaches, especially resilient tongues. Such a configuration is most especially suitable to meeting requirements particularly in the automotive sector with regard to the absorbing of transverse forces.

It may be provided that the housing has a tubular geometry and the interior of the housing is entirely electromagnetically shielded, preferably by a completely closed housing.

In one modification of the invention it may be provided that the resilient tongues of at least one of the two groups and/or all the resilient tongues are arranged evenly distributed along the circumference of the housing.

In particular, the mutual spacing of the resilient tongues in the circumferential direction can be uniform.

A uniform distribution of the resilient tongues can improve the mechanical properties of the contact element when inserting or disconnecting it. Furthermore, in this way it is possible to form uniformly distributed current paths, especially paths of equal length, in the electrical connection with the second connector, so that high frequency electrical signals can be transmitted relatively unperturbed.

The uniform distribution of the resilient tongues along the circumference of the housing can moreover optimize the shielding properties of the housing.

In one modification of the invention it may furthermore be provided that the resilient tongues of the two groups are arranged in each case in alternating fashion along the circumference of the housing.

Since the free ends of resilient tongues of the first group are facing toward the front end of the contact region and the free ends of resilient tongues of the second group are facing away from the front end of the contact region, the resilient tongues of the two groups behave mechanically differently upon being inserted. The current paths in an electrical connection with the second connector are also different in each case, as expected, for resilient tongues of the two groups. For this reason, especially in addition to a uniformly distributed arrangement of the resilient tongues, an alternating arrangement of the different attached resilient tongues may be advantageous, in order to further improve the mechanical and electrical behavior of the contact element.

As already mentioned above, the first group and/or the second group may also each have only a single resilient tongue. That is, in the meaning of the invention, it may already be sufficient to provide in all only two resilient tongues.

However, in an especially advantageous modification of the invention it may be provided that the first group and/or the second group comprises at least two resilient tongues, preferably three resilient tongues, for example also four, five, six or more resilient tongues.

Preferably, the number of resilient tongues per group is identical, but this is not absolutely required. It may also be provided, e.g., that the first group has four resilient tongues and the second group has two resilient tongues—or vice versa. Any desired compositions of the groups are possible.

Especially when using the contact element with a connector for high-frequency transmission it may be required to provide as many resilient tongues as possible arranged so as to be distributed about the circumference of the housing. In simulations and experiments it has been discovered that the use of six resilient tongues is especially advantageous for the transmission of particularly high frequencies, i.e., especially for high-frequency plug connections, in terms of manufacturing expense, where each time three resilient tongues are provided per group.

In one modification of the invention it may be provided that at least one resilient tongue, preferably one of the two groups of resilient tongues, is arranged offset from at least one further resilient tongue, preferably from the other group of resilient tongues, along the insertion direction in the housing.

Owing to an offset arrangement, the second connector (being inserted or pushed on) when connecting to the contact element can at first only make mechanical and electrical contact with one resilient tongue or a portion of the resilient tongues or a first group of resilient tongues and only then make contact with at least one further resilient tongue along the insertion direction. Thus, the plug connection can be made with especially little force, yet after the insertion is complete an overall large holding force and a low-resistance connection can nevertheless be assured.

The offsetting of the resilient tongues can be achieved in particular by setting off the positions of the respectively immovable secured ends of the resilient tongues from each other along the insertion direction in the contact region.

Alternatively or additionally, the first free ends of the respective resilient tongues may be arranged with an offset relative to each other in the contact region along the insertion direction. Moreover, the lengths of the resilient tongues, i.e., the extension between the two ends, may be different.

It may be provided that the free ends of resilient tongues of the first group are arranged at the same point or nearly the same point as the immovably secured second ends of resilient tongues of the second group along the insertion direction in the contact region, measured from the front end of the contact region.

Now, if a second connector or a contact element of a second connector is connected to the contact element according to the invention for the electrical connection, owing to the arrangement of the resilient tongues preferably along the insertion direction at first the resilient tongues of the first group will be contacted at their free ends and then the resilient tongues of the second group at their free ends.

In an especially advantageous embodiment of the invention, it may be provided that the resilient tongues of the two groups respectively have an identical spacing from the front end of the contact region and extend for the same axial distance, while a difference in the arrangement between the resilient tongues of the two groups occurs only in that the free end of the resilient tongues of the first group is facing toward the front end of the contact region and the free end of the resilient tongues of the second group is facing away from the front end of the contact region.

Preferably, it is provided according to the invention that the resilient tongues of a group are each configured identically and arranged in regard to their spacing in the front end of the contact region. However, it is basically also possible for the resilient tongues of the respective groups to be configured differently, i.e., for example, to have different lengths or also widths and/or for the spacing between the free ends of the resilient tongues from the front end of the contact region to be different. In this way, the second connector being inserted or pushed on in the insertion direction can make mechanical and electrical contact in succession with multiple resilient tongues along the insertion direction, in particular with multiple resilient tongues of the same group in succession. Thus, the force for the inserting can be further reduced, yet still having an advantageous holding force.

However, a symmetrical arrangement of the resilient tongues or the free ends of the resilient tongues about the circumference of the housing or the contact sleeve is advantageous.

Especially preferably, the contact element according to the invention is designed such that the free ends of resilient tongues of the first group are electrically contacted by an outer conductor of the second connector before an inner conductor part of the second connector electrically contacts the inner conductor part of the contact element according to the invention. Preferably, furthermore, it may be provided that a contacting of the free ends of resilient tongues only occurs after the inner conductor parts are electrically connected. It has proven to be advantageous to observe this sequence.

It may also be provided that the inner conductor part and the resilient tongues of the contact element are arranged and oriented such that all resilient tongues and the inner conductor part are electrically contacted at the same time during the connecting to a second connector. It may also be provided that the resilient tongues or the groups of resilient tongues are arranged and oriented such that at first all resilient tongues are electrically contacted and then the inner conductor parts of the connector are contacted during the connecting to a second connector.

It may also be provided that the contact sleeve and/or at least one resilient tongue has a lesser wall thickness than the housing.

Because of the fact that the contact element comprises a housing in addition to the contact sleeve or the resilient tongues, the significant mechanical stresses, such as transverse forces occurring during the inserting and removing, can be absorbed by the housing. While the wall thickness of the housing can be configured accordingly thick for this purpose, the contact sleeve or the resilient tongues can be designed in particular for producing a smooth and high-quality electrical connection. In this way, the contact normal forces and/or the forces needed for the insertion can be adjusted in extremely flexible manner by the wall thickness and/or the kind of material of the contact sleeve or the resilient tongues.

In one modification of the invention it may be provided that the housing is formed immovable or rigid orthogonally to the insertion direction.

The housing in particular can be designed to absorb mechanical transverse forces and torsional forces.

According to the invention, the combination of a rigid outer geometry of the housing of the contact element with an elastic inner geometry of the contact sleeve and/or the resilient tongues can be provided. In particular, it is possible to provide a stiffening of the entire housing of the contact element even to a preferably completely closed preferably tubular geometry. Any abutting edges due to the manufacturing process can be welded together. Preferably, the housing of the contact element has no cutouts, breaches or the like.

The wall thickness of the contact sleeve and/or the resilient tongues is preferably slight. The contact sleeve and/or the resilient tongues may be at least partially elastic in configuration, so that the inserting forces can be reduced, while at the same time having sufficiently large contact normal forces.

For example, wall thicknesses <1 mm, preferably <0.5 mm, further preferably <0.25 mm and most especially preferably <0.12 mm or even smaller can be provided.

The connecting of the contact element to the grounding conductor of the electrical line or the at least one inner conductor part to a signal conductor of the electrical line can be done with known procedures, preferably by means of soldering, gluing, clamping or crimping.

A connection of a cable to the contact element can preferably be done in that, in a first step, a piece of the cable jacket of the cable is stripped off. In this way, an outer conductor is exposed. The outer conductor may be, for example, a braided cable shield. After this, a support sleeve can be crimped onto the braided cable shield, in such a way that the braided cable shield sticks out beyond the support sleeve. The protruding braided cable shield can be turned back in a following step and laid on the support sleeve. Next, the front end of the cable can be further stripped of insulation, so that an inner conductor of the cable is exposed. The exposed inner conductor of the cable can then be connected to the inner conductor part of the contact element, preferably in such a way that the inner conductor part is likewise crimped on. The contact element or the housing of the contact element is preferably crimped onto the outer conductor of the cable or the braided cable shield, which is preferably turned back onto the support sleeve. Thus, the contact element or its housing is reliably connected to the outer conductor of the cable by crimping and the inner conductor part is protected within the contact element.

The invention also relates to a connector, especially a coupling or a bush, having a contact element as described above.

The invention furthermore relates to a plug connection, comprising a first connector, especially a coupling or bush, having a contact element as described above, and a second connector which can be plugged into it.

By the term plug connection is thus meant at present an electrical connector system, consisting of at least two electrical connectors.

Features already described in the context of the contact element according to the invention are of course also advantageously applicable to the connector according to the invention or the plug connection according to the invention—and vice versa. Moreover, advantages already mentioned in the context of the contact element according to the invention may also be understood to apply to the connector according to the invention or the plug connection according to the invention—and vice versa.

The same holds of course for the method, to be described in greater detail hereafter, for producing an electrical connection.

The invention is not limited to a specific kind of connector or to a specific connector, being suitable in particular for the manufacturing of HF cables. The connector can be designed preferably as a HF connector, especially as a PL connector, BNC connector, TNC connector, SMBA (FAKRA) connector, N connector, 7-16 connector, SMA connector, SMB connector, SMS connector, SMC connector or SMP connector.

The connector may be designed as a so-called FAKRA connector, which corresponds to the so-called FAKRA standardization scheme (FAKRA=Fachkreis Automobiltechnik, or Expert Group on Automotive Engineering) for SMB connections. This provides for a connector housing made of plastic, which holds the contact element, protects it, and prepositions it for the insertion process with a second connector. The connector housing may additionally have mechanical encodings, so that only fitting connector housings can be plugged together.

From US 2003/0176104 A1 there is known a coaxial connector with a plastic housing, corresponding to the so-called FAKRA standardization scheme for SMB connections.

Some of the components of the contact element and/or connector according to the invention may basically correspond in their construction to the coaxial connector of US 2003/0176104 A1, which is why the disclosure content of US 2003/0176104 A1 is integrated and incorporated fully into the present disclosure by this reference.

Such plastic housings for coaxial connectors, also known as FAKRA housings, find application in automotive engineering for data transmission cables. These data transmission cables are usually coaxial cables or similar shielded cables based on a single electrical inner conductor. The mechanical dimensions of such FAKRA housings in the contact region, i.e., in an axial segment of the housing which interacts with a complementary connector in order to produce a mechanical connection between the two connector housings, are established in DIN 72594-1 in the version of October 2004.

The invention is especially suitable for such connectors.

The present invention or the contact element and/or connector according to the invention can be used especially advantageously in a vehicle. The term "vehicle" describes any means of transportation, especially land, water, or air vehicles, including also spacecraft.

The invention also relates to a method for producing an electrical connection between two connectors, wherein at least a first connector is used, comprising a contact element with a contact region situated in front in the insertion direction, and wherein in the contact region there are arranged at least two resilient tongues, and the resilient tongues are each secured movably at a first free end and immovably at a second end.

In the method according to the invention it is provided that the resilient tongues are configured and arranged such that, when connecting the connectors along the insertion direction of the second connector or of the contact element or contact region thereof, at first a first group of resilient tongues of the first connector, then an inner conductor part of the first connector and then a second group of resilient tongues of the first connector make electrical contact, the free ends of the resilient tongues of the two groups in each case pointing in opposite directions.

Due to the fact that at first the resilient tongues of a first group are contacted even before a connection is made with the inner conductor of the connector, at first the ground equalizing currents may flow across the contacting outer conductor or grounding conductor of the connector, preventing unintentional damage to the system. Next, the inner conductor parts and then the resilient tongues of the second group are contacted, which further improves the electrical connection of the outer conductors of the two connectors. The plug connection fully assembled in this way can thus be suitable for the transmission of especially high frequencies.

Due to the fact that not all resilient tongues are contacted at the same time in the process of plugging together with the second connector, the frictional force or spring force acting against the plugging together can be relatively small, which may make plugging together of the connectors especially comfortable or easy for the user, while the fully closed plug connection still has a very large holding force.

The routes of the current paths inside the closed plug connection can be improved according to the invention for a high-frequency transmission by the double contacting via the two different groups of resilient tongues.

The inventors have discovered that the group of the resilient tongues whose free ends are facing away from the front end of the contact region are especially suitable for a high-frequency transmission. Furthermore, what is especially advantageous about this group of resilient tongues is that they are especially well shielded electromagnetically, since their free ends are particularly far away from the front end of the contact region.

The invention makes it possible to combine the benefits of a low junction resistance and good properties for use with high-frequency signals with a comfortably small inserting force.

It should be pointed out that the terms "comprising", "encompassing" or "having" do not preclude any other features or steps. Moreover, terms such as "a, an" or "the" which pertain to a singular number of steps or features do not rule out a plurality of steps or features, and in the present case this holds especially for the resilient tongues and the number of inner conductors.

BRIEF DESCRIPTIONS OF THE DRAWINGS

In the following, exemplary embodiments of the invention shall be described more closely with the aid of the drawing. The figures show each time preferred exemplary embodiments in which individual features of the present invention are represented in combination with each other. Features of one exemplary embodiment can also be implemented separately from the other features of the same exemplary embodiment and accordingly may be easily connected by a person skilled in the art with features of other exemplary embodiments to form further meaningful combinations and sub combinations.

In the figures, functionally identical elements are given the same reference numbers.

There are shown schematically:

WRITTEN DESCRIPTION OF THE PREFERRED EMBODIMENTS

Figure 11:
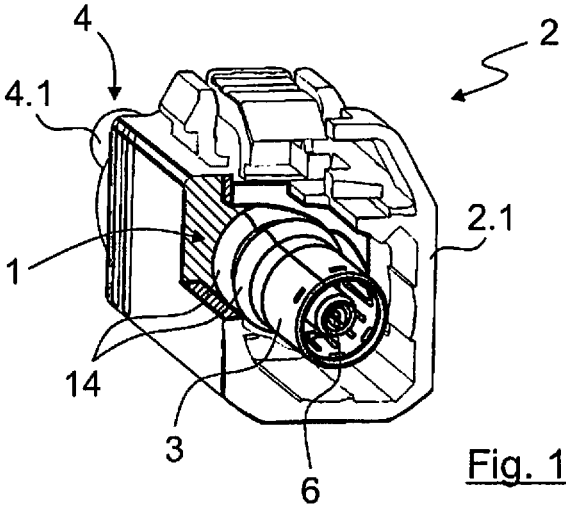
FIG. 11 is a connector according to the invention with an inserted contact element in an isometric drawing.
Figure 12:
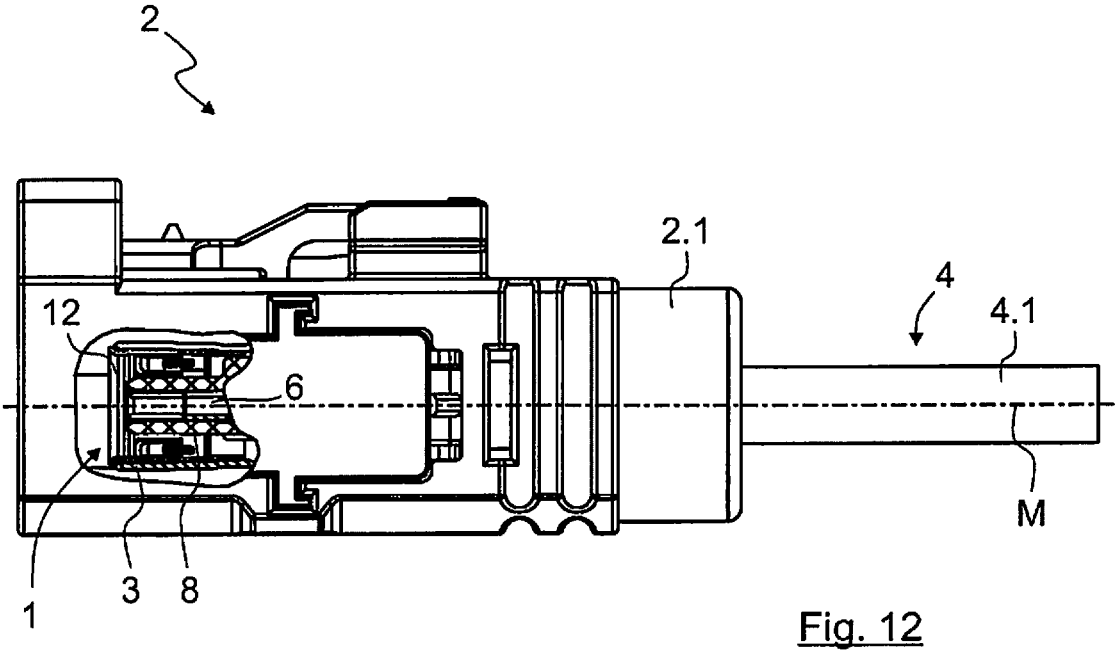
FIG. 12 is the connector according to the invention of FIG. 11 in a partly sectioned side view with the inserted contact element and with a coaxial cable.

FIGS. 1 to 6 show a contact element 1 according to the invention for a connector 2 represented as an example in FIG. 11. The contact element 1 comprises a substantially tubular housing 3 made of metal. The housing 3 of the contact element 1, but also all other components of the contact element 1, can preferably be made by punching and bending techniques.

Figure 1:
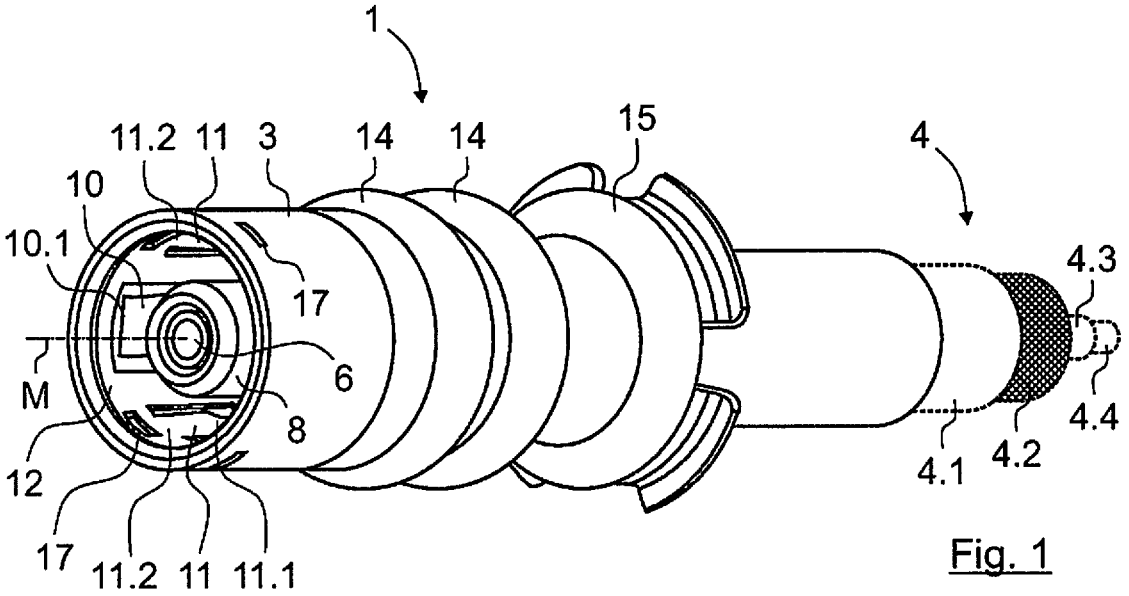
FIG. 1 is a contact element according to the invention with a coaxial cable in an isometric drawing.

The housing 3 of the contact element 1 is designed for connecting to an outer conductor 4.2 of an electrical cable 4, in the present instance a coaxial cable 4 (cf. FIG. 1). The outer conductor 4.2 in this case runs inside an insulating cable sheath 4.1. A dielectric 4.3 separates the outer conductor 4.2 electrically from an inner conductor 4.4.

Figure 2:
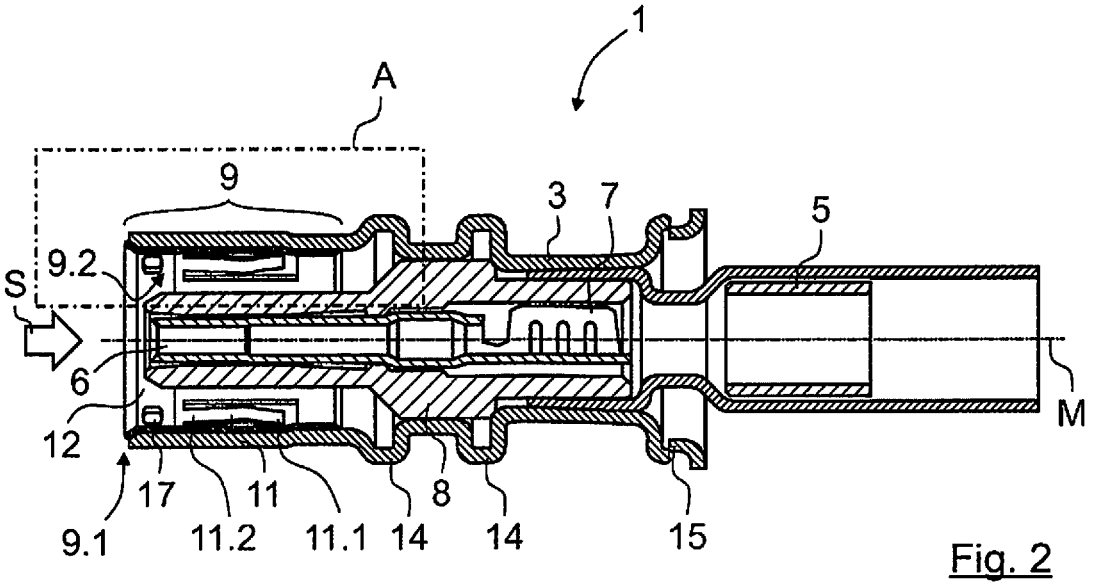
FIG. 2 is the contact element of FIG. 1 in a sectioned drawing without the coaxial cable.
Figure 6:
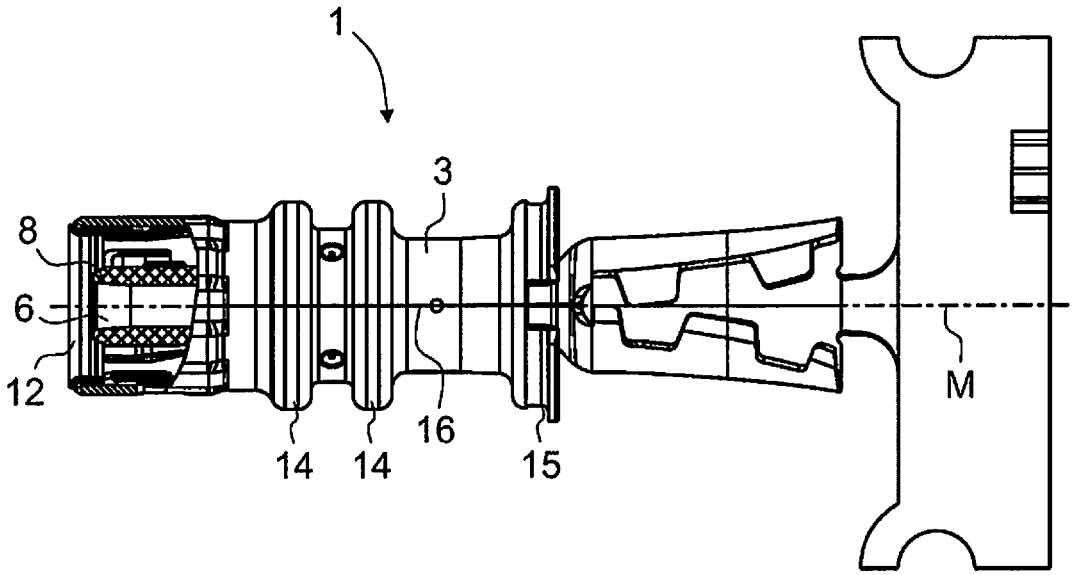
FIG. 6 is the contact element of FIG. 1 in a partly sectioned top view with a housing to receive the coaxial cable not yet closed in a rear portion.

The principle for the connecting of the contact element 1 to the coaxial cable 4 is shown especially well in FIGS. 2 and 6. The outer conductor 4.2 of the coaxial cable 4 can be connected by press-fitting or crimping to the housing 3 in a mechanically and electrically stable manner. In this way, at the same time a tension relief can be provided. In FIG. 6, the rear portion of the housing 3 which receives the coaxial cable 4 is shown bent up or opened. After inserting the coaxial cable 4, the housing 3 of the contact element 1 in the rear area can then be bent together with a corresponding tool. To improve the connection, a support sleeve 5 (cf. FIG. 2) can be provided, which is pushed onto the coaxial cable 4 and which can be folded or turned over onto the braided cable shield or the outer conductor 4.2 of the coaxial cable 4. The support sleeve 5 may then be pushed together with the coaxial cable 4 into the housing 3 of the contact element 1 and then be crimped or press-fitted.

The contact element 1 moreover comprises an inner conductor part 6 for the connection to the inner conductor 4.4 of the coaxial cable 4. Of course, basically any given number of inner conductor parts 6 or inner conductors 4.4 can be provided. The coaxial cable 4 used here as an example to illustrate the invention being an electrical line with only one inner conductor 4.4 should be understood as being only one example.

The inner conductor 4.4 of the coaxial cable 4 can be crimped to the inner conductor part 6. For example, for a force locking and form fitting connection, a contact tab 7 (cf. FIG. 2) can be provided on the inner conductor part 6, which after inserting the inner conductor 4.4 of the coaxial cable 4 can be bent around it.

For the orienting of the inner conductor part 6 inside the housing 3 and for the electrical insulation between the outer conductor 4.2 and the inner conductor 4.4, an electrically insulating support 8 can be provided, such as one made of plastic. This is shown especially well in FIG. 2.

For a stable mechanical and electrical connection to a second connector 2' (shown only as an example in FIG. 13), multiple resilient tongues 10, 11 are arranged on a contact region 9 (cf. FIG. 2) of the housing 3 situated at the front in the insertion direction, each time the resilient tongues 10, 11 being secured movably at a first free end 10.1, 11.1 and immovably at a second end 10.2, 11.2.

The insertion direction is shown in FIG. 2 by an arrow S and it runs along the center axis M of the contact element 1. By the contact region 9 of the housing 3 is meant the region which serves substantially for the mechanical and electrical contacting with a second connector 2'. Thus, in this region there are situated at least the front end of the inner conductor part 6 and the resilient tongues 10, 11 for contacting an outer conductor of the second connector 2'.

In the exemplary embodiment, the contact element 1 comprises an electrically conductive contact sleeve 12, which is electrically connected to the housing 3 of the contact element 1 and forms the resilient tongues 10, 11. Basically, however, the resilient tongues 10, 11 may also be formed on the housing 3 (as a single piece with it, or otherwise). In the exemplary embodiment, the contact sleeve 12 as well as the housing 3 of the contact element 1 is formed entirely of metal and by punching and bending techniques.

The housing 3 and also the contact sleeve 12 each have a round cross section. The housing 3 is formed entirely closed along its circumference, so that an especially advantageous electromagnetic shielding can be provided. Moreover, the housing 3 is formed so as to be immovable or rigid orthogonally to the insertion direction, especially so as to absorb large transverse forces and to assure a good shielding. The housing 3 of the contact element 1 preferably has a larger wall thickness than the contact sleeve 12. The contact sleeve 12 is preferably elastic in configuration and enables a plugging together with the second connector 2' with relatively slight forces. For example, a wall thickness of 0.12 mm may be provided for the contact sleeve 12.

According to the invention, two groups of resilient tongues 10, 11 are provided, the free ends 10.1 of resilient tongues 10 of a first group facing toward a front end 9.1 of the contact region 9 (cf. FIG. 2) and the free ends 11.1 of resilient tongues 11 of a second group facing away from the front end 9.1 of the contact region 9.

The contact region 9 in the exemplary embodiment forms an inner space 9.2 to receive the second connector 2', the free ends 10.1, 11.1 of the resilient tongues 10, 11 protruding into the inner space 9.2 for the contacting with the second connector 2'. Alternatively, it may also be provided that the second connector 2' is pushed onto the contact element 1 and the free ends 10.1, 11.1 of the resilient tongues 10, 11 thus stick out outwardly for the contacting of the housing 3 of the contact element 1.

Figure 4:
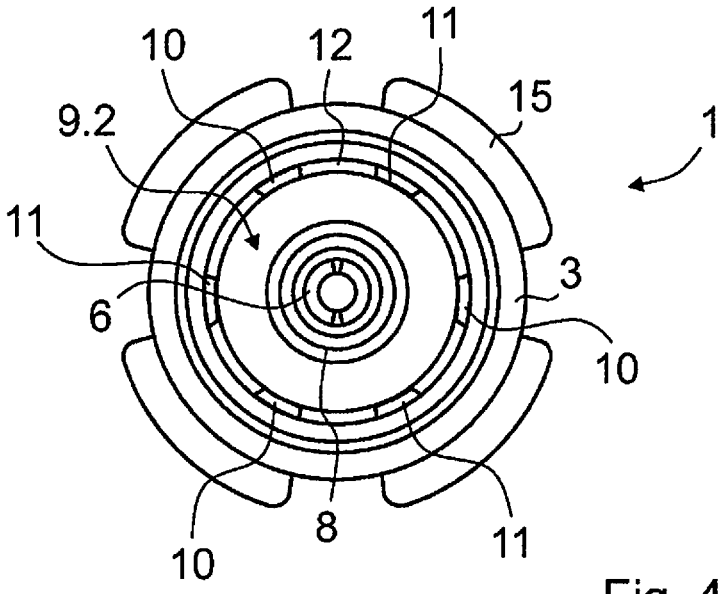
FIG. 4 is the contact element of FIG. 1 in a front view.
Figure 5:
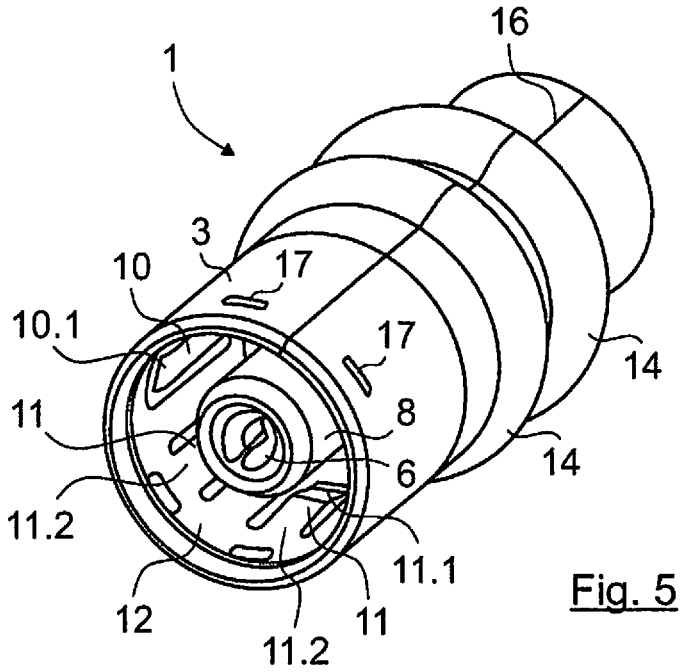
FIG. 5 is the front part of the contact element in another isometric drawing.
Figure 7:
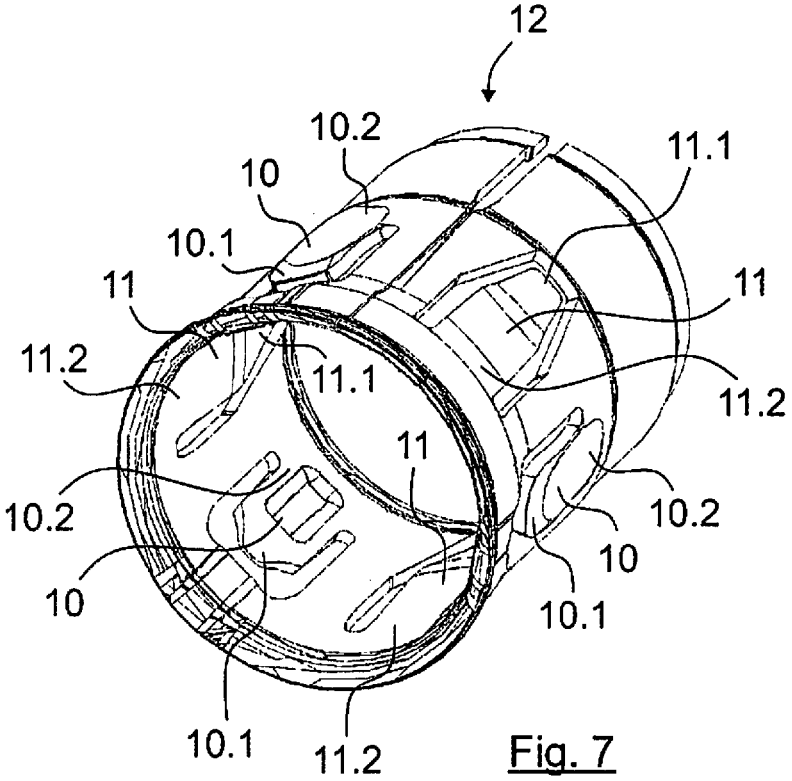
FIG. 7 is a contact sleeve according to the invention in an isometric drawing.
Figure 8:
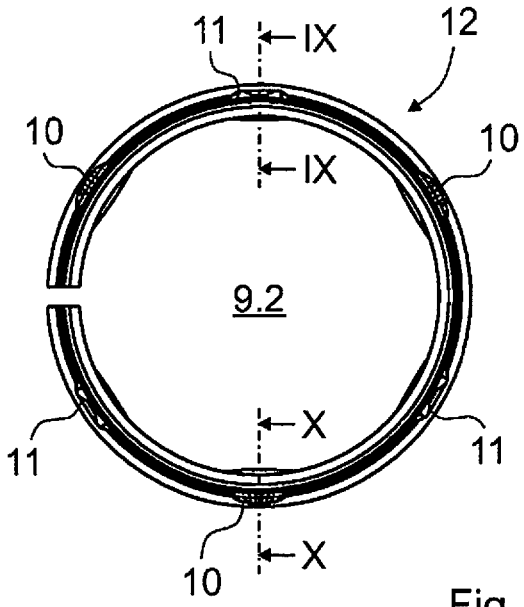
FIG. 8 is the contact sleeve of FIG. 7 in a front view.

As is shown especially well in FIGS. 4, 7 and 8, in the exemplary embodiment six resilient tongues 10, 11 are provided. Each time, three resilient tongues 10 of the first group and three resilient tongues 11 of the second group are arranged. The resilient tongues 10 of the first group and the resilient tongues 11 of the second group are in this case arranged distributed uniformly and in alternating fashion along the circumference of the housing 3 of the contact element 1 (or the contact sleeve 12). This ensures a certain symmetry of the current paths when connected to the second connector 2' and also a symmetry in the mechanical connecting of the connector 2, 2', so that a plug connection can be plugged together especially comfortably and furthermore it is suitable for the transmitting of signals with especially high frequencies.

Figure 3:
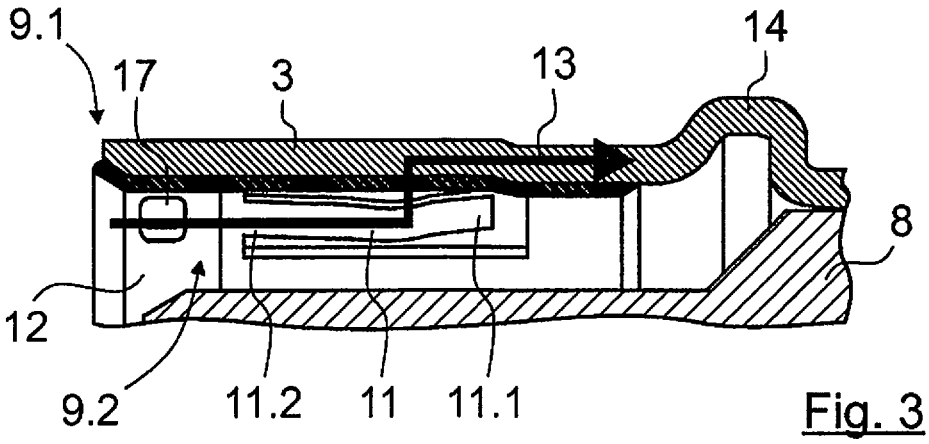
FIG. 3 is detail "A" of the sectioned contact element of FIG. 2.

An exemplary current path 13 across a resilient tongue 11 of the second group is shown by FIG. 3. When the second connector 2' or the contact element of the second connector 2' is pushed fully into the contact element 1, the resilient tongue 11 shown is basically pressed out from the inner space 9.2 of the contact region 9 and against the side wall of the housing 1. In this way, when the second connector 2' has been fully inserted, an additional more mechanically stable and directly running electrical contact with the housing 1 is produced by the resilient tongue 11.

Figure 9:
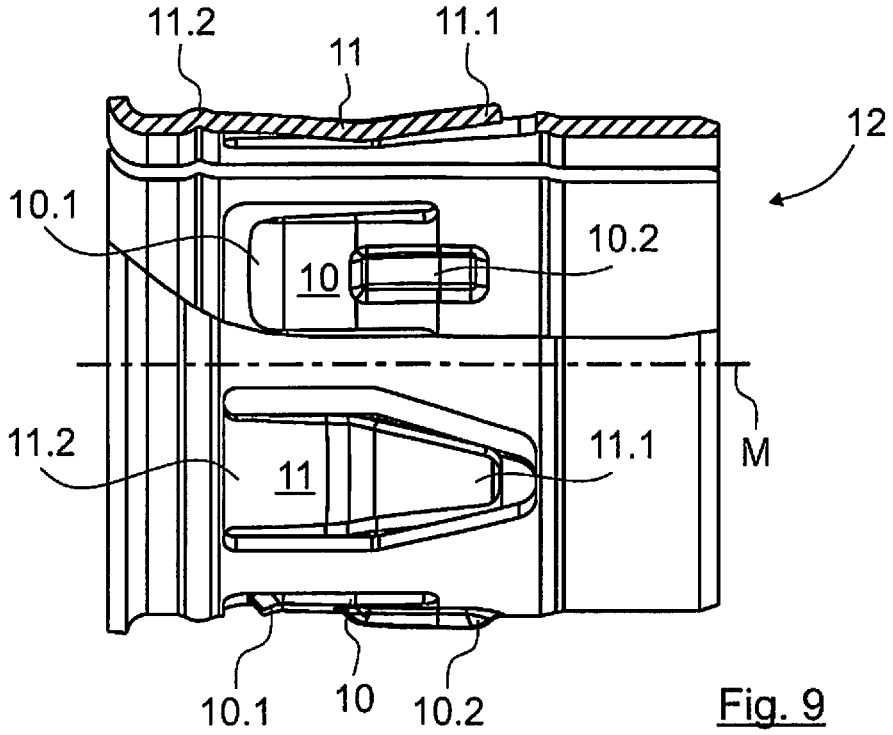
FIG. 9 is the contact sleeve of FIG. 7 in a first partly sectioned side view along section IX-IX of FIG. 8.
Figure 10:
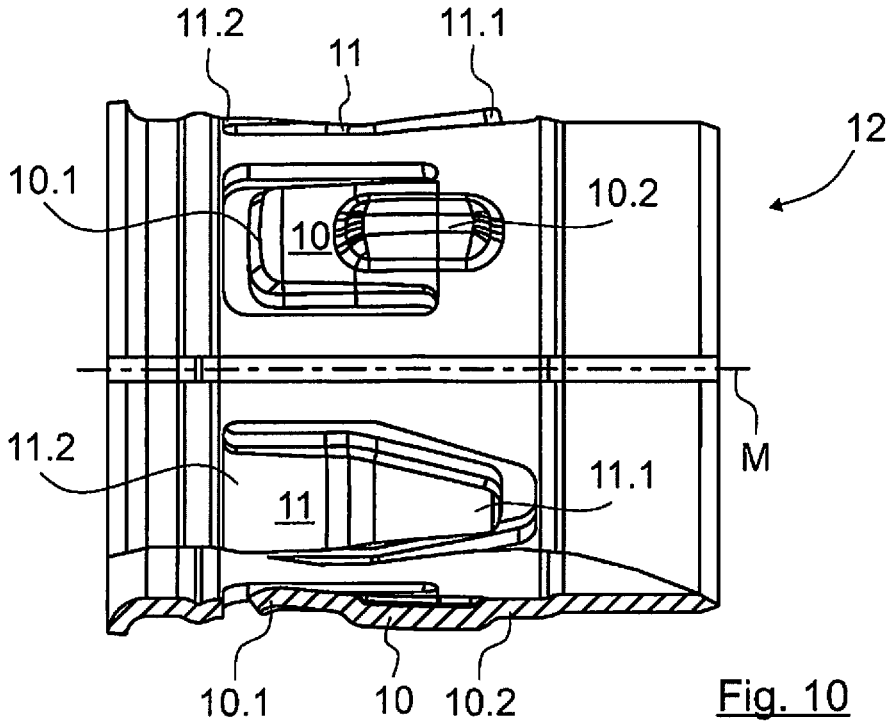
FIG. 10 is the contact sleeve of FIG. 7 in a second partly sectioned side view along section X-X of FIG. 8.

FIGS. 9 and 10 show respectively partly sectioned side views of the contact sleeve 12 shown in FIG. 7. FIG. 9 shows a partial section along the sectioning line IX-IX of FIG. 8 and FIG. 10 along the sectioning line X-X of FIG. 8.

In the exemplary embodiment, the resilient tongues 10 of the first group and the resilient tongues 11 of the second group are arranged with an offset along the insertion direction in the housing 3. When producing an electrical connection between a connector 2 according to the invention, having a contact element 1 with a contact sleeve 12, as shown, and a second connector 2', preferably at first the first group of resilient tongues 10 of the connector 2 according to the invention, then the inner conductor part 6 of the connector 2 according to the invention and then the second group of resilient tongues 11 of the connector 2 according to the invention are electrically contacted when connecting the connectors 2, 2' along the insertion direction of the second connector 2'. For this, the free ends 10.1 of the resilient tongues 10 of the first group, which protrude into the inner space 9.2 of the contact region 9, are situated further in front on the contact element 1 than the front part of the inner conductor part 6 and the free ends 11.1 of the resilient tongues 11 of the second group. This ensures that ground equalizing currents can occur across the respective outer conductors prior to the electrical connecting of the inner conductors of the connectors 2, 2', and at the same time an insertion with less inserting force can be assured, since at first only the first group of resilient tongues 10 is mechanically contacted.

The invention also relates to a connector 2 with a contact element 1 as described above.

FIGS. 10 and 11 show as an example a FAKRA connector 2 in the configuration of a coupling. The connector 2 in this case comprises a connector housing 2.1, which is preferably made of plastic. Basically, any given connector 2 can be provided. In the connector housing 2.1, the above described contact element 1 is installed. For a better representation, the connector housing 2.1 is shown in each case partly sectioned in FIGS. 10 and 11.

The connector housing 2.1 and the housing 3 of the contact element 1 each have mechanical coding means and fastening means for the mutual connection and/or orientation. The housing 3 of the contact element 1 for this purpose comprises for example two annular bulges 14 and one disk bulge 15.

Depending on the production method for the contact element 1 and the housing 3 of the contact element 1, the housing 3 may have an abutting edge 16 (cf. FIG. 5), which is preferably welded.

The housing 3 and the contact sleeve 12 may be press-fitted together and/or they may have interlocking means 17. The interlocking means 17 may be formed in particular by partial depressions and/or complementary eminences on the housing 3 and/or the contact sleeve 12. The interlocking means 11 in the housing 3 are preferably formed such that they do not pierce the housing 3. Preferably, the interlocking means 17 of the housing 3 are depressions formed on the inside of the housing 3, which interlock with the complementary eminences on the contact sleeve 12.

Figure 13:
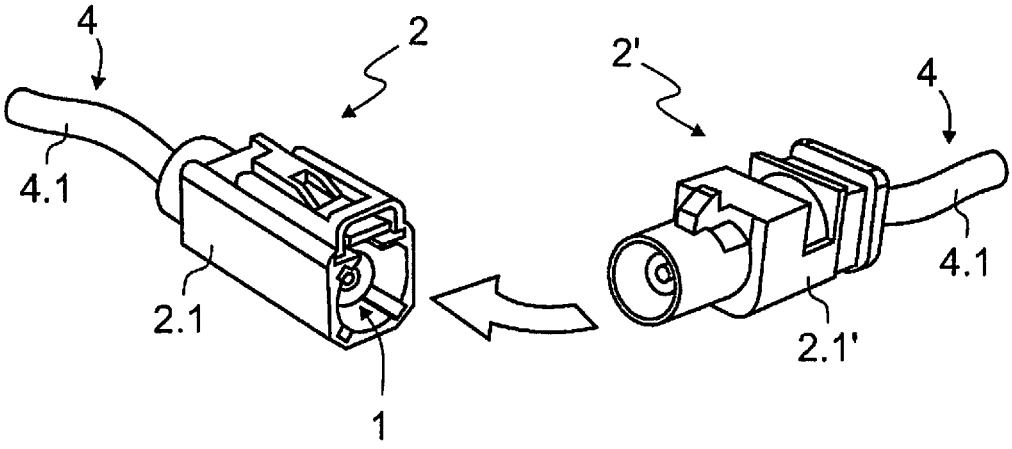
FIG. 13 is a plug connection according to the invention with a connector according to the invention and a second connector in an isometric drawing.

The invention also pertains to an electrical connector system or an electrical plug connection, having a first connector 2, especially a coupling or a bush, with a contact element 1, as described above, wherein the electrical plug connection moreover comprises a second connector 2', which can be plugged together with the first connector 2. FIG. 13 shows as an example a second connector 2' with a connector housing 2.1'. The second connector 2' is configured here as a FAKRA plug and the connector 2 according to the invention as a FAKRA coupling.

We claim:

1. A contact element for a connector comprising:

an at least partially electrically conductive housing for connection to a grounding conductor of an electrical line, the contact element having at least one inner conductor part for connection to at least one signal conductor of the electrical line, and wherein a contact region which is located at a front end of the housing, in the insertion direction, has at least two resilient tongues, and wherein the at least two resilient tongues are each secured, to the contact region and are each movable at a first free end and are each immovable at a second secure end; and wherein the resilient tongues of a first group of the at least two resilient tongues are arranged such that the first free ends are arranged facing toward a front end of the contact region and the resilient tongues of a second group of the at least two resilient tongues are arranged such that the first free ends are arranged facing away from the front end of the contact region; and wherein the contact region forms an inner space to receive a second connector and the first free ends of the at least two resilient tongues protrude into the inner space for the contacting with the second connector; and wherein at least one resilient tongue, and preferably one of each of the two groups of resilient tongues, is arranged offset from at least one other resilient tongue, preferably from the other group of resilient tongues, along the insertion direction in the housing.

2. The contact element as claimed in claim 1, and wherein, the contact element comprises an at least partially electrically conductive contact sleeve, which is electrically conductively connected to the housing, and which forms the at least two resilient tongues.

3. The contact element as claimed in claim 2 and wherein, the contact sleeve has a round cross section.

4. The contact element as claimed in claim 2, and wherein, the contact sleeve is formed entirely of metal.

5. The contact element as claimed in claim 1, and wherein, the at least two resilient tongues are formed as a single piece with the housing.

6. The contact element as claimed in claim 1, and wherein, the housing is formed entirely of metal.

7. The contact element as claimed in claim 1, and wherein, the housing is formed fully closed at least in the contact region along its circumference.

8. The contact element as claimed in claim 1, and wherein, the at least two resilient tongues of at least one of the two groups and/or all the resilient tongues are arranged evenly distributed about a circumference of the housing.

9. The contact element as claimed in claim 1, and wherein, the at least two resilient tongues of the two groups are arranged in alternating orientation about a circumference of the housing.

10. The contact element as claimed in claim 1, and wherein, the first group and/or the second group of resilient tongues comprises at least two resilient tongues.

11. The contact element as claimed in claim 1, and wherein, the housing is immovable orthogonally relative to the insertion direction.

12. The contact element as claimed in claim 1, and wherein, the first group and/or the second group of resilient tongues comprise at least three resilient tongues.

13. The contact element as claimed in claim 1, and wherein, the first group and/or the second group of resilient tongues comprise at least four, resilient tongues.

14. The contact element as claimed in claim 1, and wherein, the first group and/or the second group of resilient tongues each comprise plural resilient tongues.

15. A plug connection for establishing an electrical connection comprising:

a first connector that is a coupling or a bush, the first connector having, a contact element with a contact region at a front end in an insertion direction, and wherein the contact region has at least two resilient tongues, and the at least two resilient tongues are each secured, and are each immovable at a second secured end, and are each movable at a first tree end, and wherein, the at least two resilient tongues are each configured and arranged such that, when connecting the first connector to a second connector along the insertion direction, a first group of the at least two resilient tongues of the first connector, and thereafter, an inner conductor part of the first connector, and then thereafter, a second group of the at least two resilient tongues of the first connector make electrical contact with the second connector, and the movable first free ends of the at least two resilient tongues of the two groups of the at least two resilient tongues are pointing in opposite directions; and the second connector is plugged into the first connector to establish the electrical connection between the first connector and the second connector.

16. A method for producing an electrical connection between two connectors, comprising:

providing a second connector; and providing a first connector, comprising a contact element with a contact region situated in a front end in an insertion direction, and wherein the contact region of the contact element has at least two resilient tongues, and the at least two resilient tongues are each secured, and are each immovable at a second secured end and are each movable at a first free end, and wherein, the at least two resilient tongues are each configured and arranged such that, when connecting the first and second connectors along an insertion direction of the second connector first, a first group of the at least two resilient tongues of the first connector, and thereafter, an inner conductor part of the first connector, and then thereafter, a second group of the at least two resilient tongues of the first connector make electrical contact, and the movable first free ends of the at least two resilient tongues of the two groups of the at least two resilient tongues are pointing in opposite directions.

17. The method of producing an electrical connection between two connectors of claim 16 and wherein, the first group and/or the second group of the at least two resilient tongues each comprise plural resilient tongues.

* * * * *